US011622654B2

(12) United States Patent
Smith

(10) Patent No.: US 11,622,654 B2
(45) Date of Patent: Apr. 11, 2023

(54) ROTATING SHOWER CHAIR

(71) Applicant: Platinum Health, LLC, Orlando, FL (US)

(72) Inventor: Randall L. Smith, Orlando, FL (US)

(73) Assignee: Platinum Health, LLC, Orlando, FL (US)

( * ) Notice: Subject to any disclaimer, the term of this patent is extended or adjusted under 35 U.S.C. 154(b) by 18 days.

(21) Appl. No.: 17/484,406

(22) Filed: Sep. 24, 2021

(65) Prior Publication Data

US 2022/0095849 A1 Mar. 31, 2022

Related U.S. Application Data

(60) Provisional application No. 63/085,419, filed on Sep. 30, 2020.

(51) Int. Cl.
*A47K 3/28* (2006.01)

(52) U.S. Cl.
CPC ..... *A47K 3/282* (2013.01)

(58) Field of Classification Search
CPC ..... A47K 3/282; A47K 3/122
USPC ..... 4/611
See application file for complete search history.

(56) References Cited

U.S. PATENT DOCUMENTS 4,391,006 A * 7/1983 Smith ..... A47K 3/122 4/579
4,472,844 A * 9/1984 Mace ..... A47K 3/122 4/579
5,903,935 A * 5/1999 Huelke ..... A47K 3/122 4/578.1
9,468,573 B2 * 10/2016 Edwards ..... A61G 7/1059
10,722,033 B1 * 7/2020 Chen ..... A47C 3/18

* cited by examiner

*Primary Examiner* — Huyen D Le
(74) *Attorney, Agent, or Firm* — McHale & Slavin, P.A.

(57) ABSTRACT

Disclosed is a rotatable shower chair that couples to the side wall of a bathtub. The platform for the rotatable shower chair cannot be moved until the platform is uncoupled from the bathtub sidewall. The seat is rotatable, allowing an individual to control rotation by movement of individual's body. A grab rail is placed along one side of the seat platform to facilitate repositioning by the bather.

14 Claims, 9 Drawing Sheets

ROTATING SHOWER CHAIR

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 63/085,419, entitled "ROTATING SHOWER CHAIR", filed Sep. 30, 2020. The contents of the above referenced application are incorporated herein by reference.

FIELD OF THE INVENTION

The present invention is directed to the field of bathing accessories and, in particular, to a rotating seat assembly that allows an individual to safely enter a bathtub to prepare for taking a shower.

BACKGROUND OF THE INVENTION

Loss of independence and privacy in the bathroom can be extremely difficult for those physically injured and disabled, as well as the elderly. A particularly hazardous endeavor in the bathroom is bathing, as many individuals are unable to step into a bathtub. Conventional bathtubs require the traversing over a sidewall of the tub in order to position an individual in an area where proper washing is possible using the tub as a catch basin and drain. Unfortunately, bathtubs are notoriously slippery, as the materials of construction are designed to be easily cleaned, and any misstep can cause the individual to fall. Placing tub mats or friction tape onto tub surfaces helps prevent slips and falls, but can trap moisture and become a breeding ground for bacteria.

Those with diminished mobility may resort to grasping tub seats, towel bars, and other bathroom fixtures with disastrous results. Slip and falls in the bathtub are major problems for individuals as they attempt to enter or exit the bathtub. It is a top priority to protect the disabled and elderly population when bathing.

Bathing seats are known in the industry and typically consist of a seat supported by four legs providing an elevated platform over the tub catch basin, wherein an individual can allow water to flow into the catch basin. Variations of the bathing seat include rotating seat tops and slide mechanisms which allow the individual to move from a position outboard of the bath catch basin to a position inboard of the bath catch basin. While such devices provide great security to the bather, they take up space within the catch basin, thereby requiring removal for cleaning of the catch basin or taking of a shower. In addition, their portability can allow the device to shift while the bather is being situated. Further, in some instances, the most dangerous aspect in entering or exiting a bathtub is the need to step over the side wall of the bathtub. Failure to properly traverse the sidewall is most dangerous with the elderly or those individuals with limited mobility.

Accordingly, what is lacking in the industry is a rotating shower chair that couples to a side wall of a conventional bathtub, allowing an individual to raise their feet over the sidewall of the bathtub while in a safe seated position, leaving the bathtub water catch basin free of interference for showering or cleaning purposes.

SUMMARY OF THE INVENTION

The present invention is a rotatable shower chair having a first side that couples to the side wall of a bathtub, with two outboard adjustable legs depending from a second side. Once the seat is coupled to the bathtub, the seat cannot be moved, providing a stable platform to the bather. The platform for the rotatable shower chair cannot be moved until the platform is uncoupled from the bath sidewall. In one embodiment, the center of the seat platform is rotatable, allowing an individual to control rotation by movement of an individual's body. In another embodiment, the entire seat is rotatable, wherein rotation is controlled by the individual's leg placement. A padded, weight bearing grab rail is placed along one side of the seat platform to facilitate repositioning by a user.

Accordingly, it is an objective of the instant invention to provide a rotatable shower chair that is releaseably coupled to the sidewall of a bathtub for stability and eliminating the need for two of the four chair legs.

It is a further objective of the instant invention to provide a rotatable shower chair that does not consume the bath catch basin, allowing an individual to take a shower without movement of the rotatable shower chair.

Another objective of the invention is to provide a chair having a first side that is positioned adjacent the bath catch basin and a second side that extends minimally outboard of the bathtub.

Still another objective of the invention is to provide a device to safely move an individual into and out of a bathtub by providing full support of the individual in a seated position as they raise their feet to enter or exit the bathtub.

Another objective of the invention is to provide a shower seat that is adjustable to accommodate different sized bathtub wall thicknesses and heights.

Yet still another objective of the invention is to provide a rotatable seat that is lightweight and can be shipped in preassembled components, allowing quick assembly without tools.

Another objective of the invention is to provide a seat assembly constructed and arranged to allow an individual to rotate positions by transferring their weight from a non-rotatable section to a rotatable section.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
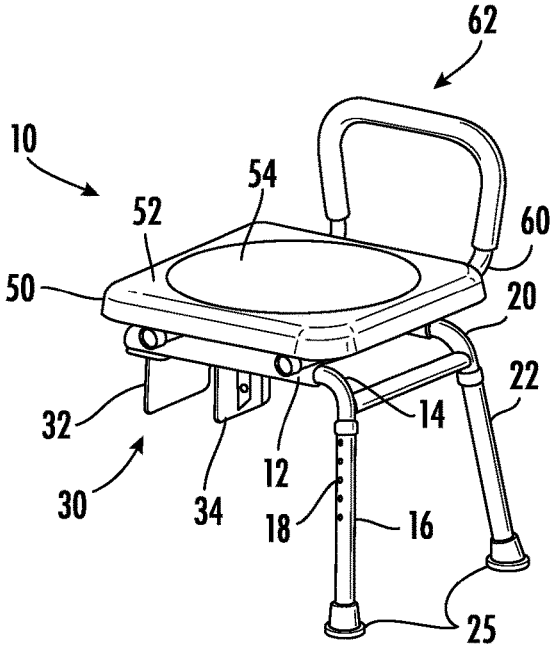
FIG. 1 is a perspective view of the rotatable shower chair of the present invention.
Figure 2:
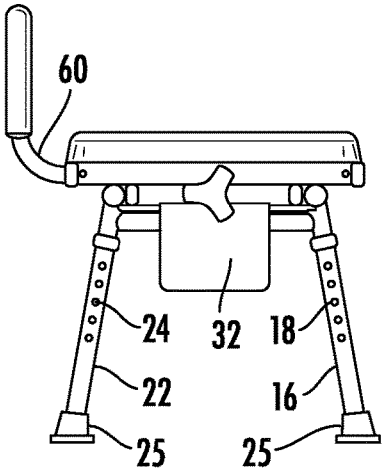
FIG. 2 is a right side view thereof.
Figure 3:
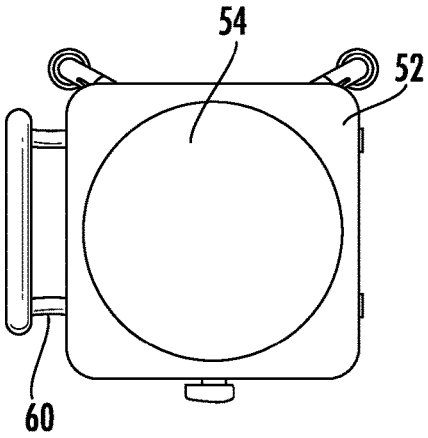
FIG. 3 is a top view thereof.
Figure 4:
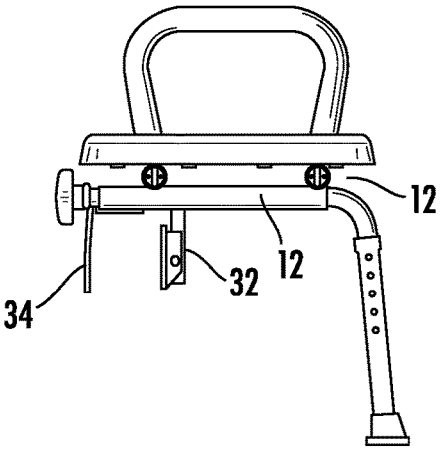
FIG. 4 is a rear view thereof.
Figure 5:
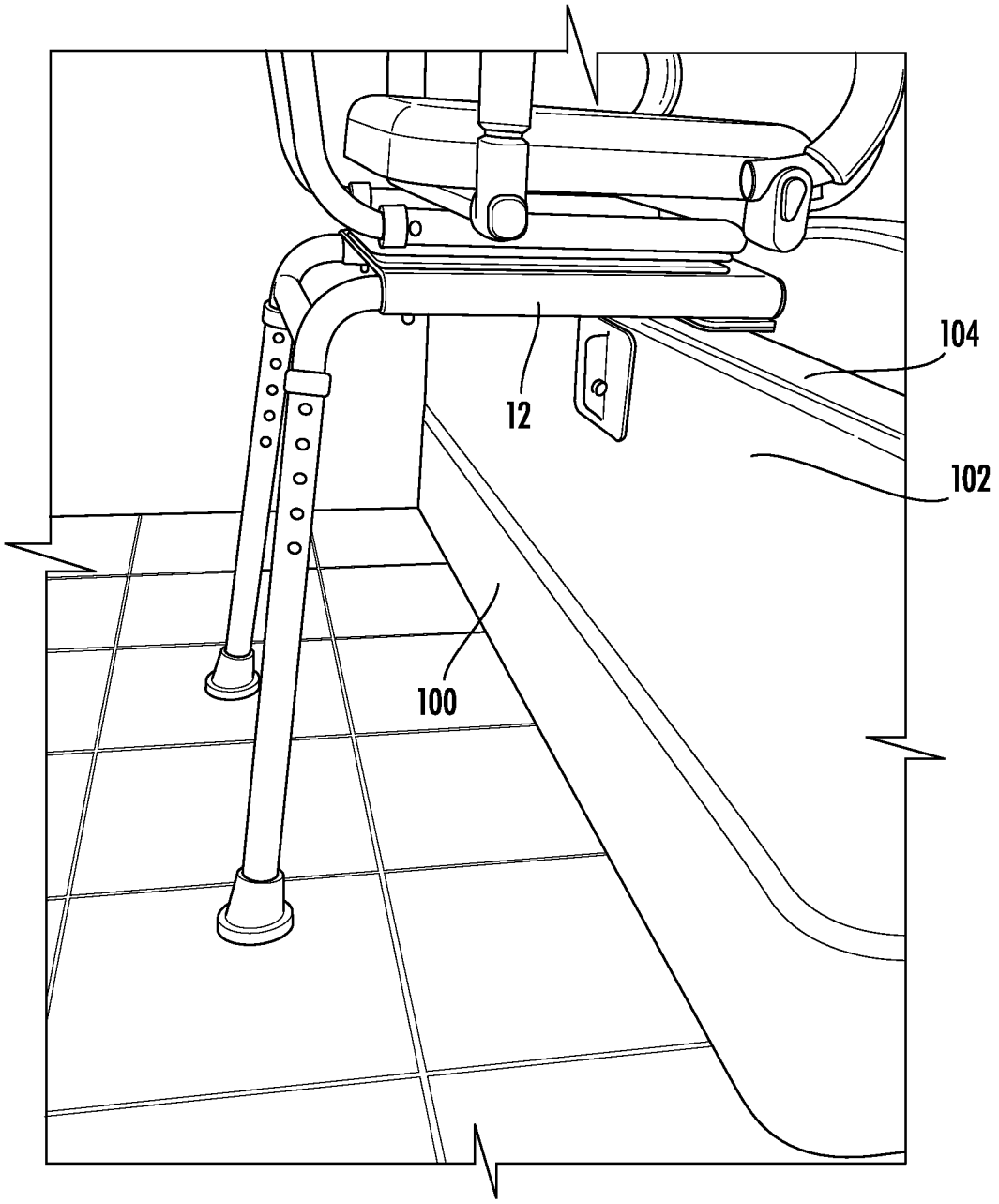
FIG. 5 is a front view thereof.
Figure 6:
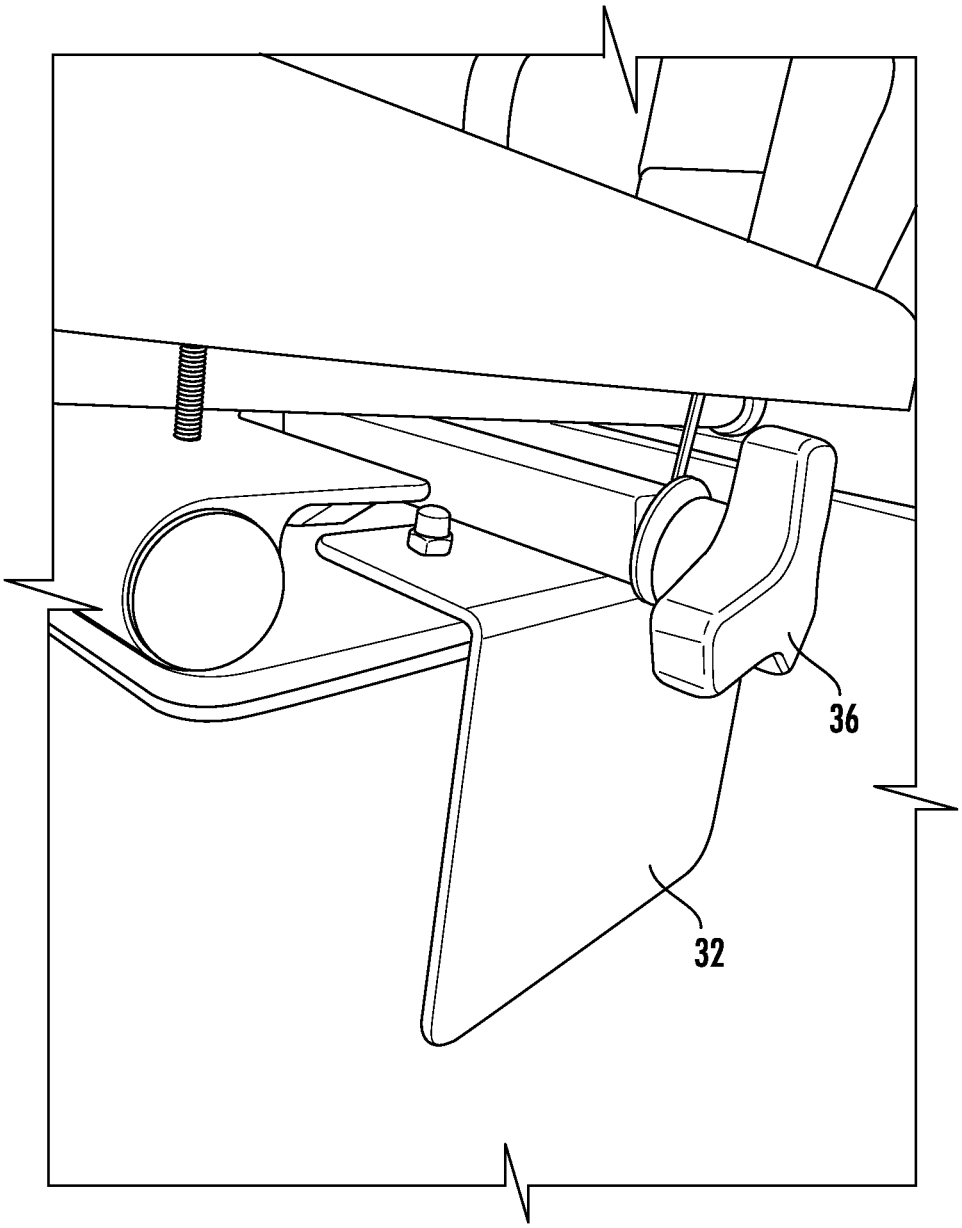
FIG. 6 is a perspective view of the coupling bracket.
Figure 7:
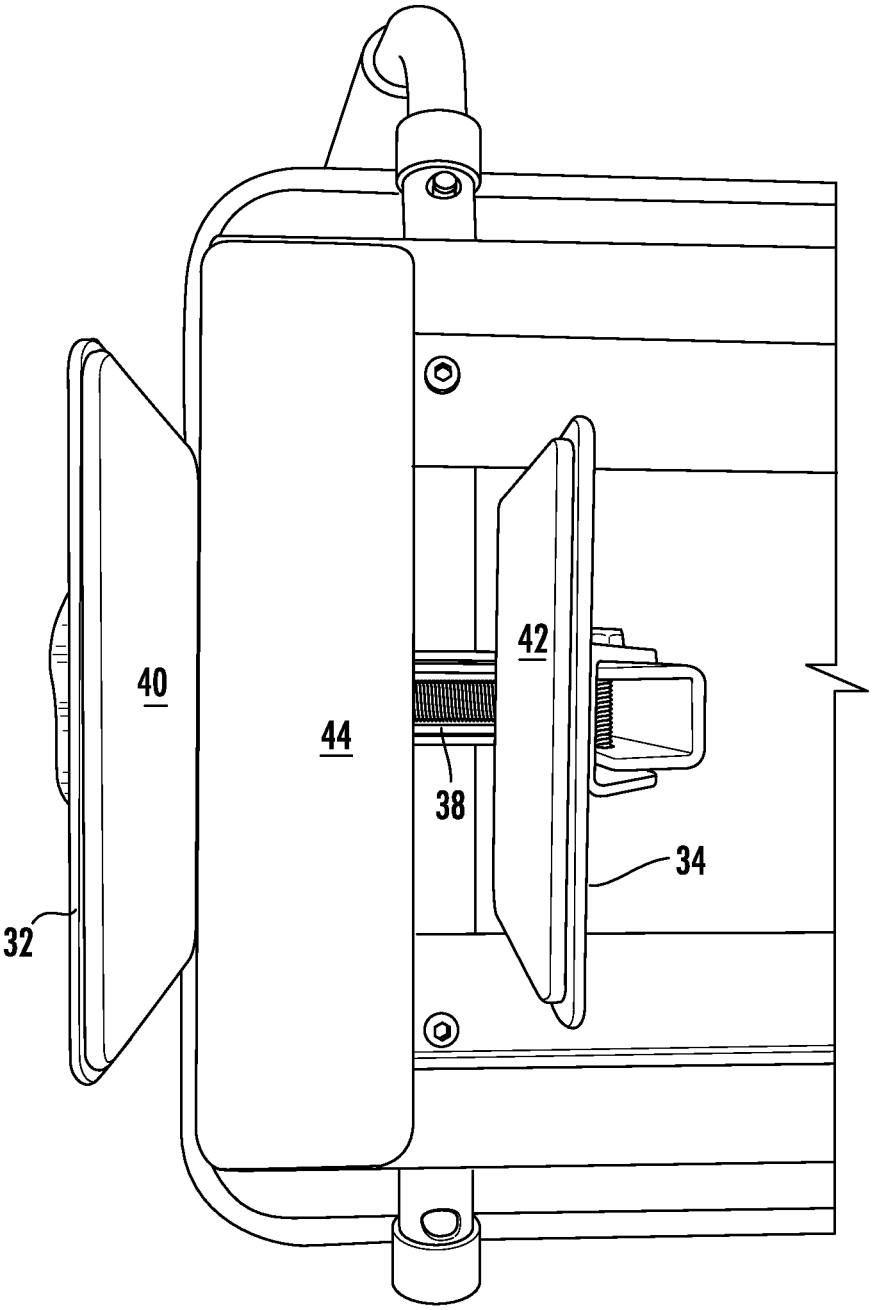
FIG. 7 is a bottom view of the coupling bracket.
Figure 8:
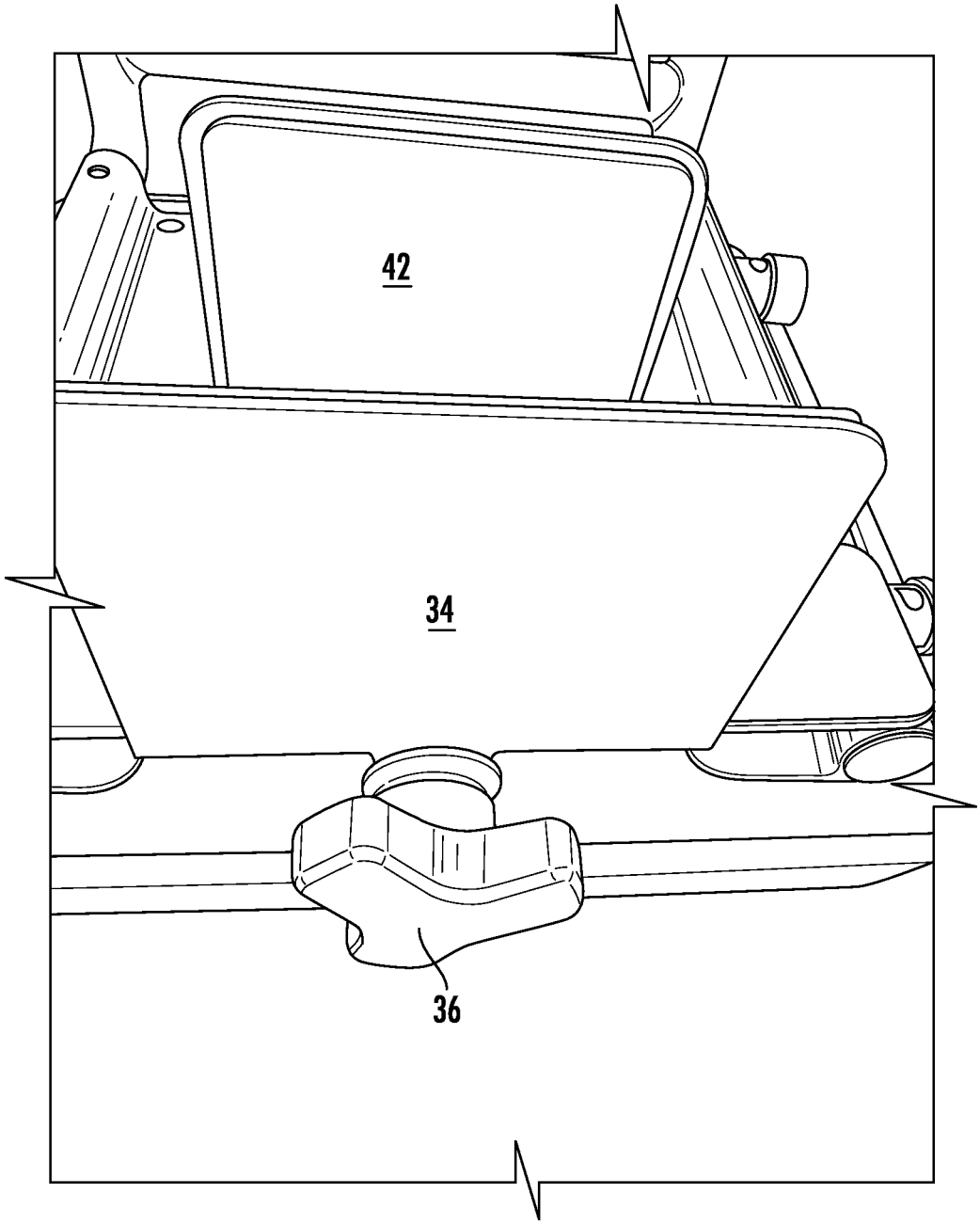
FIG. 8 is a bottom perspective view of the coupling bracket.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1-8, disclosed is a rotatable shower chair 10 comprising a base 12 formed having a first support tube 14 with a first leg 16 depending therefrom; the first leg 16 having an adjustment mechanism 18 to position the first support tube 14 at a position above an upper edge 104 of a bathtub 100. A second support tube 20 has a second leg 22 depending therefrom; the second leg 22 having an adjustment mechanism 24 to position the second support tube 20 at a position above the upper edge 104 of the bathtub 100. In one embodiment, the adjustment mechanism 18, 24 is a spring loaded protrusion that allows for the slidable placement of each leg 16, 22 within each support tube 14, 20 at a length to accommodate the side wall 102 of a bathtub; the protrusion being depressed to allow the movement of a leg within a support tube, the protrusion extending outward from a support tube aperture upon selection of the proper length. The end of the legs 14, 22 include non-slip leg end caps 25.

The base 12 includes a coupler 30 formed from a stationary vertical plate 32 and a movable vertical plate 34. The stationary vertical plate 32 is positioned against the inner sidewall of a bathtub 100, and the moveable plate 34 is used to press against the outer sidewall 102 of the bathtub 100, thereby sandwiching the bathtub wall therebetween. The movable vertical plate 34 is coupled to a rotatable handle 36 which rotates screw drive 38, causing placement movement of the moveable plate 34. The coupler 30 includes a non-slip, non-marring pad 40 on the inner wall of the stationary vertical plate 32, a non-slip, non-marring pad 42 on the inner wall of the movable vertical plate 34, and a non-slip, non-marring pad 44 on the bottom of the base 12. The coupler 30 frictionally secures the base 12 to the bathtub 100.

A seat assembly 50 is secured to the upper side of the base 12. In a preferred embodiment, the seat assembly 50 has a fixed outer edge 52 that is secured to the base 12, and a rotatable inner section 54. In this embodiment, the centrally rotatable inner section 54 allows an individual to control rotation by movement of an individual's body. The rotatable inner section 54 has a slide or bearing support to support up to 330 lbs. In another embodiment, not shown, the entire seat assembly is rotatable, wherein rotation is controlled by the individual's leg placement. A grab rail 60 extends from the base 12, providing a rigid padded handle 62 that an individual may rely upon during positioning. As the base 12 is coupled to the side wall 102 of the bathtub, the handle 62 is positioned directly over the bathtub side wall 102 to assure direct loading from a vertical position.

The rotatable shower chair 10 is shipped wherein the seat assembly 50, legs 16, 22 and grab rail 60 are secured to the base 12 prior to use. The base 12 is placed over the upper edge 104 of a bathtub 100, and the legs 16, 22 adjusted by an umbrella type push button adjustment mechanism 18, 24 to place the base at a level height. The rotatable handle 36 is used to transfer the moveable plate 34, sandwiching the bathtub wall 102 therebetween.

Figure 9:
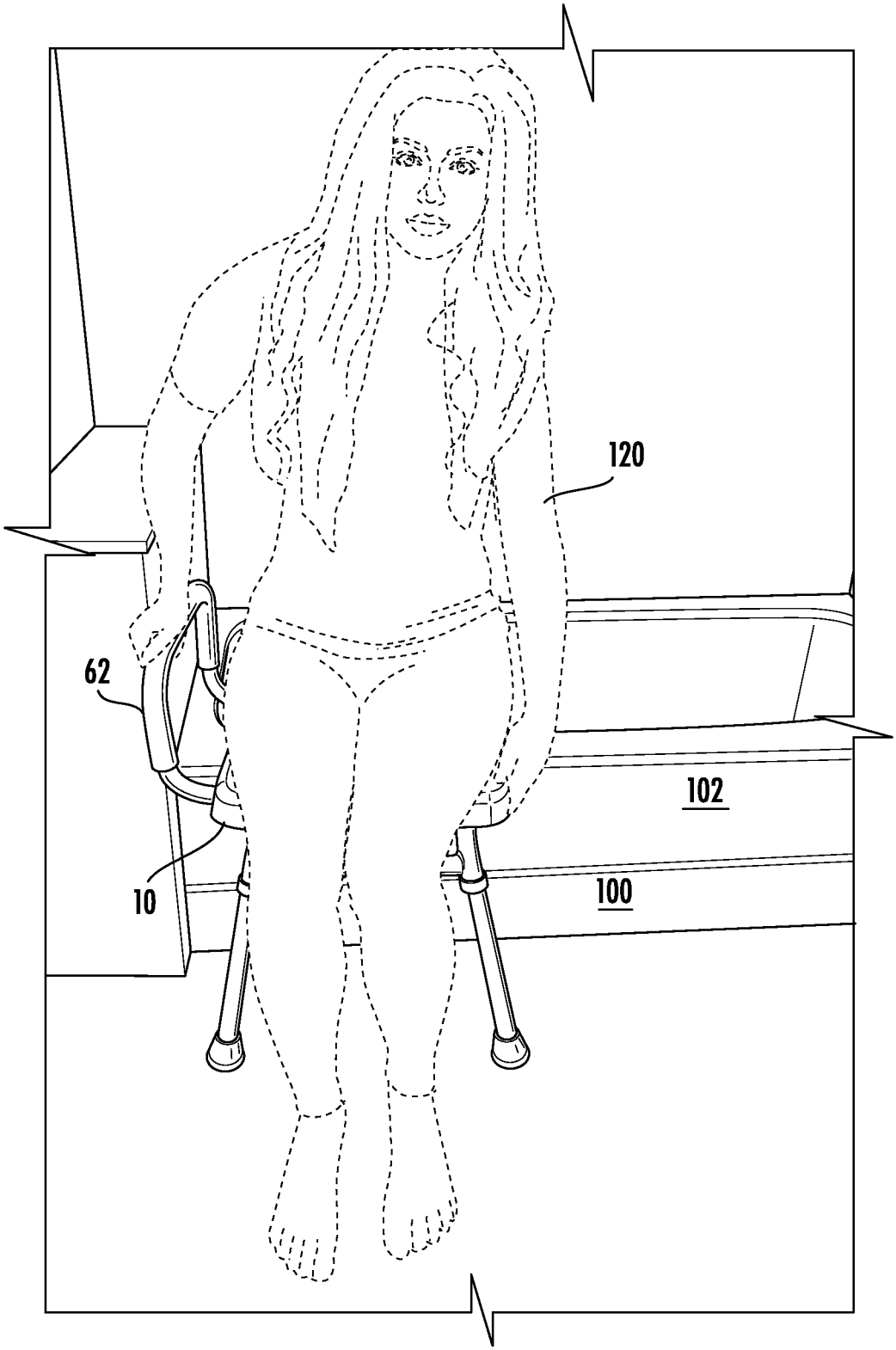
FIG. 9 is a pictorial view of an individual seated outboard of a bathtub.
Figure 10:
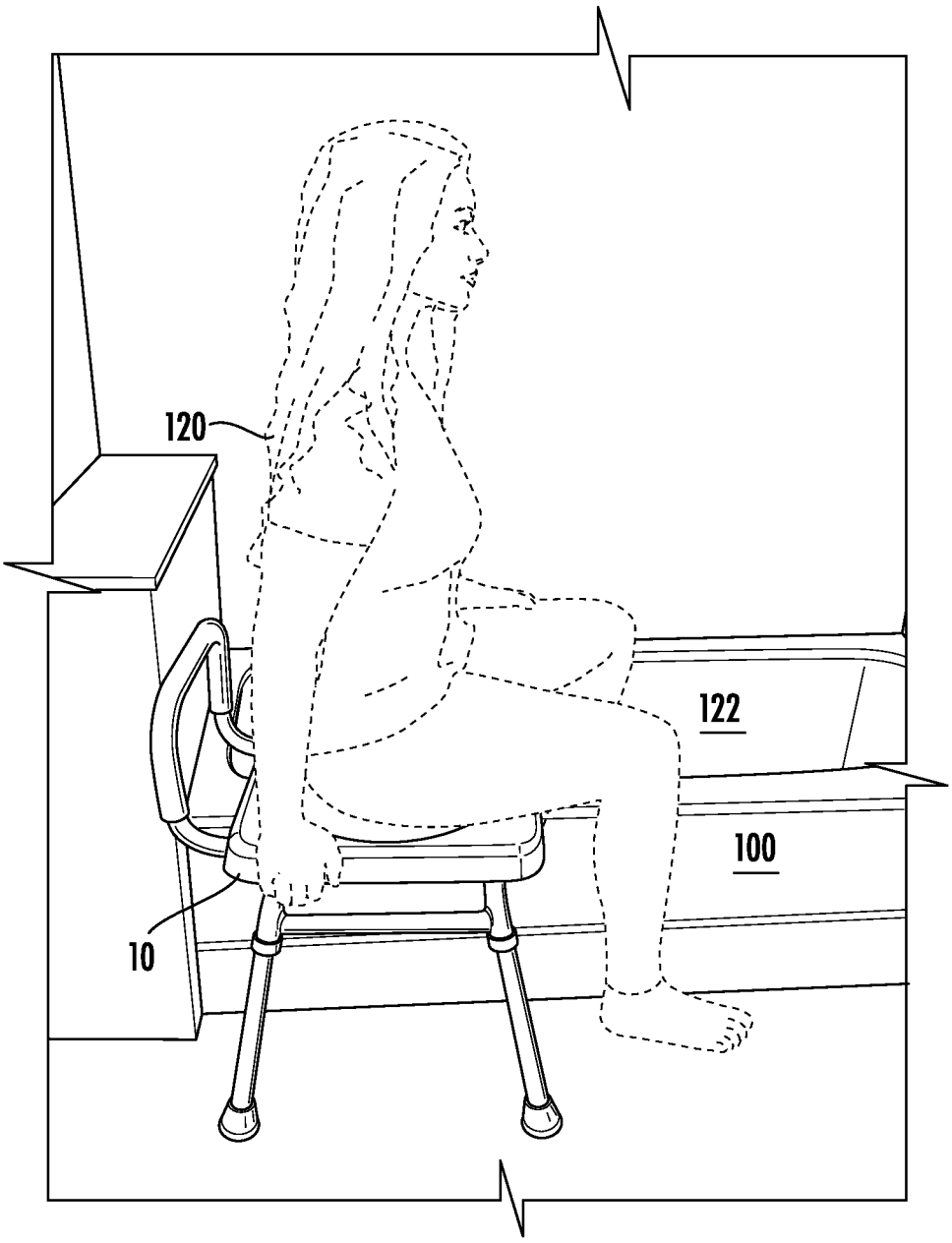
FIG. 10 is a pictorial view of an individual rotated parallel to the bathtub.
Figure 11:
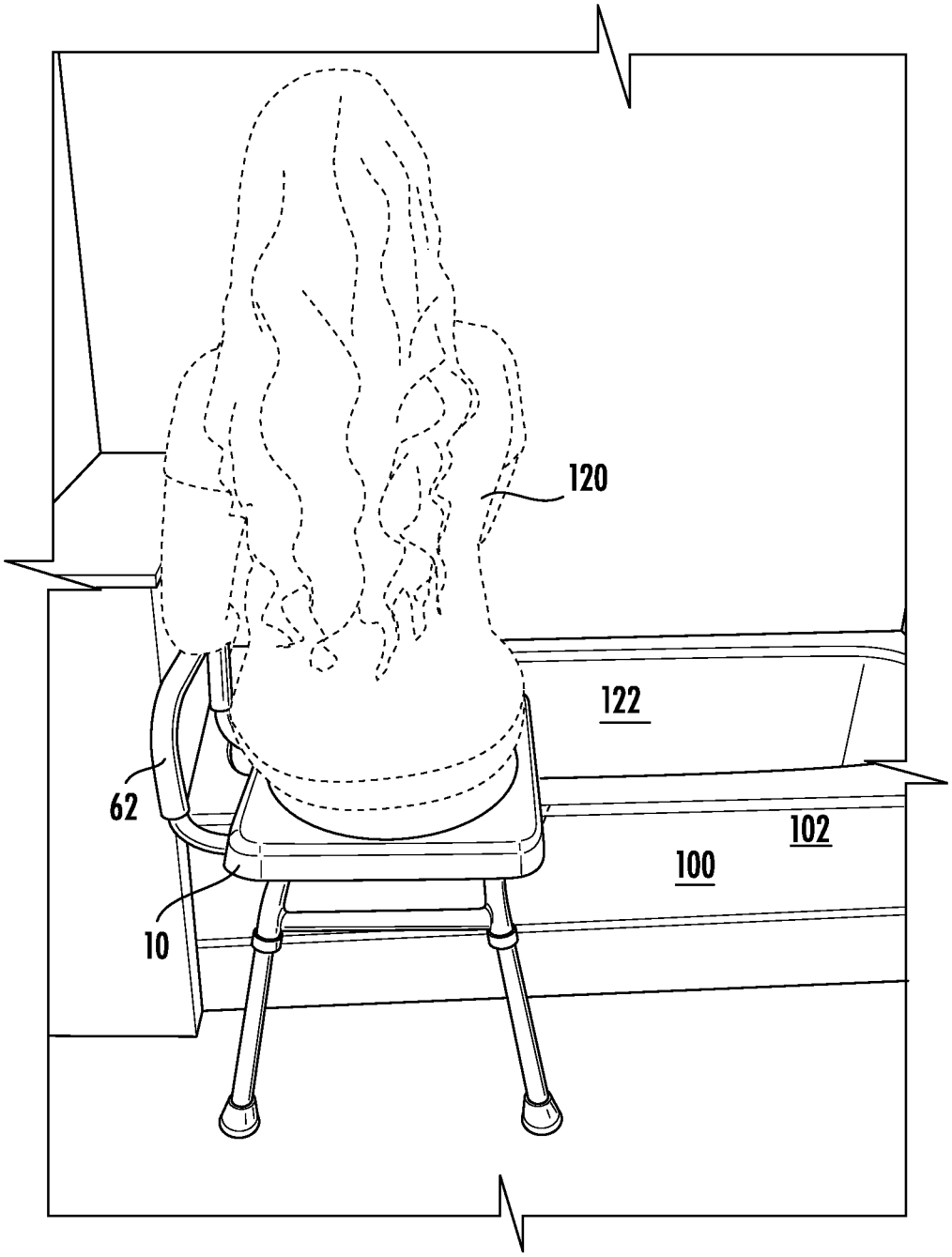
FIG. 11 is a pictorial view of an individual seated inboard of a bathtub.
Figure 12:
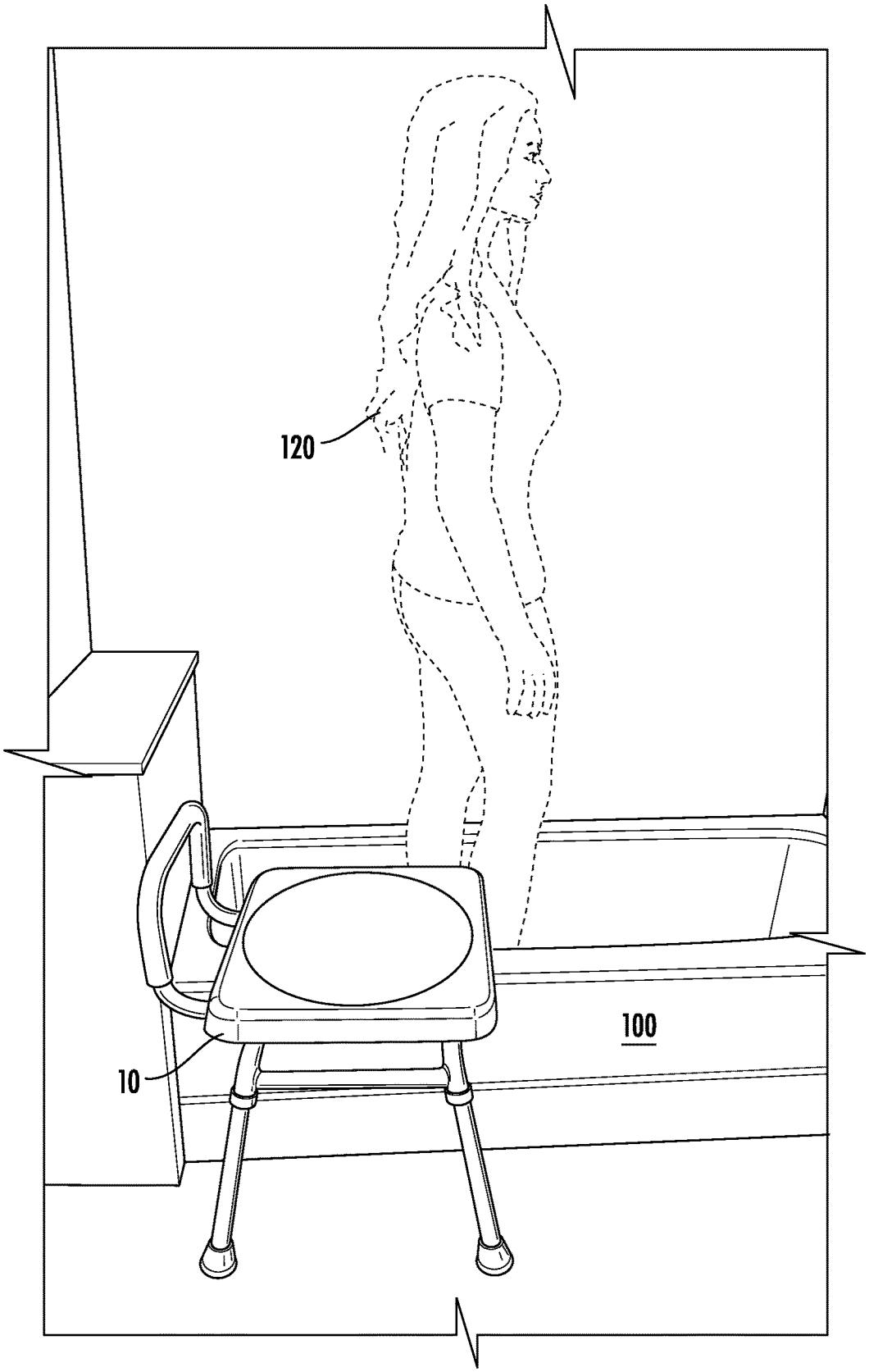
FIG. 12 is a pictorial view of an individual standing in the water catch basin of the bathtub.

Referring to FIGS. 9-12, a pictorial representation illustrates use of the rotatable seat assembly 10 attached to a bathtub 100. FIG. 9 depicts an individual 120 sitting down on the rotating seat 10 with their back to the bathtub 100. The padded handle 62 provides the individual support during the seating process. Referring to FIG. 10, the individual then rotates the seat assembly 10 in a position parallel to the sidewall 102 of the bathtub 100. FIG. 11 depicts the individual in a fully rotated position, wherein the individual's feet are now placed within the water catch basin 122 of the bathtub 100. Using the grab rail 60 for support, the individual 120 may now stand in the water catch basin 122 of the bathtub 100, illustrated in FIG. 12, wherein the individual is standing in the water catch basin 122 without interference from the rotatable seat assembly 10. To exit the bathtub, the individual 120 simply reverses the procedure. The operation allows the individual 120 full support in a seated position as they raise their feet to enter or exit the bathtub.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A rotatable shower seat comprising:

a base formed having a first side with a first leg and a second leg depending therefrom;

a coupler depending from a second side of said base, said coupler formed from a stationary vertical plate positioned along an outer sidewall of a bathtub and a moveable vertical plate positioned along an inner sidewall of the bathtub, said moveable vertical plate secured to a screw drive, wherein rotation of said screw drive positions the bathtub sidewall between the stationary and movable vertical plates; and a rotatable seat secured to said base.

2. The rotatable shower seat according to claim 1 including a grab rail secured to said base.

3. The rotatable shower seat according to claim 1 wherein each said leg is operatively associated with a support tube, wherein each said leg is adjusted in length to position said seat assembly in a level position over an upper edge of the bathtub sidewall.

4. The rotatable shower seat according to claim 1 wherein said stationary vertical plate includes a non-slip, non-marring pad on an inner wall for engaging the outer sidewall of the tub.

5. The rotatable shower seat according to claim 1 wherein said movable vertical plate includes a non-slip, non-marring pad on an inner wall for engaging the inner sidewall of the tub.

6. The rotatable shower seat according to claim 1 wherein a bottom of said base resting on the upper edge of the bathtub includes a non-slip, non-marring pad.

7. The rotatable shower seat according to claim 1 including a handle coupled to an end of said screw drive, wherein rotation of said handle allows placement of said movable vertical plate.

8. The rotatable shower seat according to claim 1 including non-slip caps secured to a distal end of each said leg.

9. The rotatable shower seat according to claim 1 wherein said rotatable seat includes a centrally disposed rotatable section constructed and arranged to permit an individual to rotate from a first position to a second position.

10. A rotatable shower seat comprising:

a base formed having a first side with a first leg and a second leg depending therefrom, each said leg is operatively associated with a support tube, wherein each said leg is adjusted in length to position said seat assembly in a level position over an upper edge of the bathtub sidewall;

a coupler depending from a second side of said base, said coupler formed from a padded stationary vertical plate positioned along an outer sidewall of a bathtub and a padded moveable vertical plate positioned along an inner sidewall of the bathtub, said moveable vertical plate secured to a screw drive, wherein rotation of said screw drive positions the bathtub sidewall between the stationary and movable vertical plates; and a seat assembly secured to said base, said seat assembly including a centrally disposed rotatable section constructed and arranged to permit an individual to rotate from a first position to a second position.

11. The rotatable shower seat according to claim 10 including a grab rail secured to said base.

12. The rotatable shower seat according to claim 10 including a handle coupled to an end of said screw drive, wherein rotation of said handle allows placement of said movable vertical plate.

13. The rotatable shower seat according to claim 10 including non-slip caps secured to a distal end of each said leg.

14. The rotatable shower seat according to claim 10 wherein said seat assembly includes a rotatable section and a non-rotatable section constructed and arranged to allow rotation by an individual shifting their weight.

* * * * *